US005242013A

United States Patent [19]

Couëtoux et al.

[11] Patent Number: 5,242,013

[45] Date of Patent: Sep. 7, 1993

[54] MOUNTING FOR A MOTORIZED FAN UNIT ON A COOLING RADIATOR FOR A MOTOR VEHICLE

[75] Inventors: Hervé Couëtoux; Thierry Collette, both of Versailles, France

[73] Assignee: Valeo Thermique Moteur, Le Mesnil-Saint-Denis, France

[21] Appl. No.: 839,346

[22] Filed: Feb. 20, 1992

[30] Foreign Application Priority Data

Feb. 21, 1991 [FR] France ..... 91 02098

[51] Int. Cl.[5] ..... F28F 13/00

[52] U.S. Cl. ..... 165/121; 165/122; 123/41.49

[58] Field of Search ..... 165/121, 122; 123/41.11, 41.49

[56] References Cited

U.S. PATENT DOCUMENTS 1,782,105 11/1930 Spreen ..... 165/121
2,103,105 12/1937 Young ..... 165/121 X
2,286,398 6/1942 Young ..... 165/121
2,366,376 1/1945 Young et al. ..... 165/122 X
2,401,918 6/1946 Elder et al. ..... 165/122

FOREIGN PATENT DOCUMENTS 0093817 11/1983 European Pat. Off. .
0259182 3/1988 European Pat. Off. .
2349945 4/1974 Fed. Rep. of Germany .
3838868 6/1989 Fed. Rep. of Germany .

*Primary Examiner*—Allen J. Flanigan
*Attorney, Agent, or Firm*—Morgan & Finnegan

[57] ABSTRACT

The motor of a motorised fan unit for a motor vehicle radiator lies outside the perimeter of the radiator considered in the direction of the axis of rotation of the cooling fan, while its dimension in the same direction is at least partly superimposed on the thickness of the tube bundle in the radiator. The drive motor drives the cooling fan, which is arranged facing the tube bundle, through a drive belt. The size of the assembly in the axial direction is reduced, and the motor does not interfere with the flow of air through the radiator.

16 Claims, 6 Drawing Sheets

MOUNTING FOR A MOTORIZED FAN UNIT ON A COOLING RADIATOR FOR A MOTOR VEHICLE

FIELD OF THE INVENTION

This invention relates to apparatus for effecting heat transfer between a fluid and ambient air, in particular though not exclusively for the cooling of a coolant fluid of a motor vehicle engine.

BACKGROUND OF THE INVENTION

Such an apparatus is known, comprising a heat exchanger having two opposed, parallel main faces and a bundle of tubes which extend parallel to the main faces and which are open into at least one water box of the heat exchanger, the apparatus further including a cooling fan arranged facing one of the main faces of the heat exchanger and in air communication with the tube bundle, with the cooling fan being arranged to rotate about an axis of rotation at right angles to the main faces whereby to produce a forced air stream through the heat exchanger, the apparatus also including a drive motor for driving the cooling fan, the motor and the cooling fan being secured to the heat exchanger. Such an apparatus will be referred to herein as apparatus of the kind specified.

In conventional apparatus of the kind specified, the drive motor is arranged on the same side of the heat exchanger as the cooling fan (i.e. it is associated with the same main face of the latter as the fan), the cooling fan being mounted directly on the output or drive shaft of the motor. This arrangement does have the advantage of simplifying the fitting of the motorised fan unit on the heat exchanger and to render superfluous any additional means for transmitting motion between the motor and the cooling fan. However, these advantages are more than offset by the following drawbacks. Firstly, the size of the drive motor in the axial direction is quite large, and adds to the overall thickness of the tube bundle. Secondly, the drive motor itself, and the means whereby it is fastened to the heat exchanger, tend to mask a not inconsiderable proportion of the exposed surface of the heat exchanger, thus reducing the cross section which is available for circulation of the air driven by the cooling fan. Thirdly, the drive motor and the cooling fan have to rotate at the same velocity as each other, even though, for optimum performance, they should rotate at different speeds. Finally, in the case in which the motorised fan unit lies downstream of the tube bundle of a cooling radiator (considered in the direction of flow of the forced air stream), the motor is in a draught of air which has already been heated by its contact with the tubes of the heat exchanger. This is detrimental to proper cooling of the motor itself.

DISCUSSION OF THE INVENTION

An object of the invention is to overcome the drawbacks described above.

According to the invention, in an apparatus of the kind specified, the drive motor is disposed outside the perimeter of the heat exchanger, while its dimension in the direction of the axis of rotation of the cooling fan is at least partly superimposed on the thickness of the heat exchanger.

Since the drive motor lies outside the perimeter of the heat exchanger it does not interfere with the circulation of air directly through the tube bundle. In addition, since the weight of the cooling fan is much smaller than that of the drive motor, the means whereby the cooling fan is secured on the heat exchanger may be made smaller, thus further increasing the flow cross section available for circulation of the air. Furthermore, the superimposition of the axial dimension of the drive motor on the thickness of the tube bundle reduces the size of the apparatus in the direction of this thickness. This advantage is particularly important in current motor vehicle manufacture, in which the space available in the engine compartment is strictly limited.

The drive motor is preferably disposed on the opposite side of the associated water box from the tube bundle. It may then be secured on a mounting face provided on the water box itself.

Alternatively, however, and in accordance with a preferred feature of the invention, the cooling fan may be mounted on a support member extending past the main face of the heat exchanger with which the cooling fan is associated, the support member being secured on the heat exchanger in the region of the or a water box and also in another region of the heat exchanger remote from or opposite to the first mentioned region; the drive motor is then mounted on a portion of the support member which is cantilevered with respect to the same water box.

The dissociation of the axes of rotation of the drive motor and cooling fan from each other enables the drive means to be arranged as a speed reducing mechanism, having drive elements which give the cooling fan a lower rotational velocity than the motor. It is in fact of advantage for the performance of the motor that the latter should rotate at a relatively high speed, but the cooling fan would produce a disagreeable noise if it rotated at that high speed. Thus the conventional compromise by which neither the fan nor the motor runs at its optimum speed is replaced by an arrangement in which they can both run at their optimum speeds.

Finally, when the cooling fan is arranged downstream of the tube bundle, in the direction of the forced air stream, the arrangement of the apparatus in accordance with the invention renders the drive motor impervious to this air stream, and in particular avoids any danger of the drive motor being heated by air that has been heated in contact with the tubes.

Further features and advantages of the invention will become clearer from a reading of the detailed description of preferred embodiments of the invention which follows, and which is given by way of example only and with reference to the accompanying drawings.

DESCRIPTION OF PREFERRED EMBODIMENTS OF THE INVENTION

Figure 1:
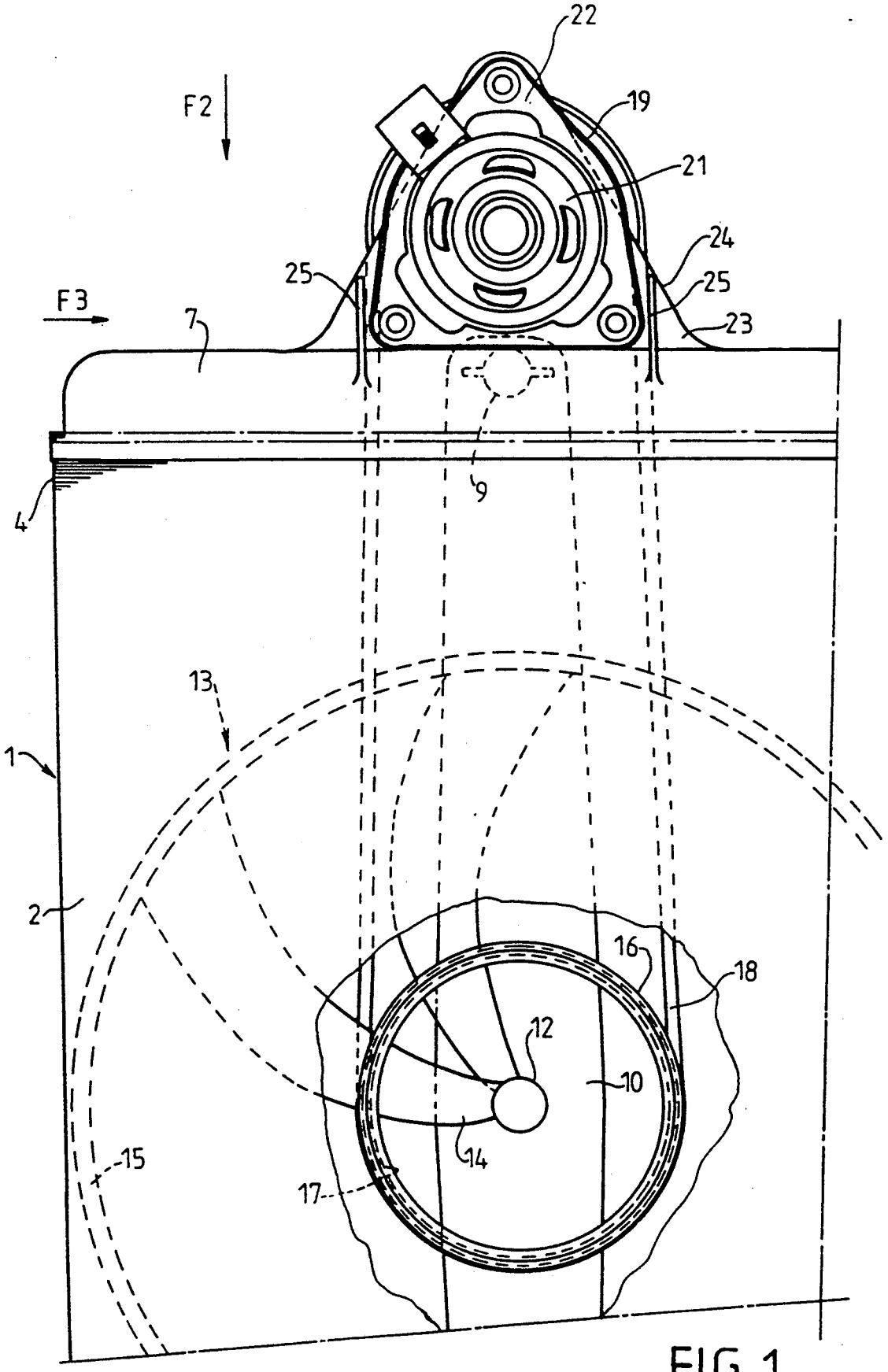
FIG. 1 is a view in elevation of part of an apparatus in accordance with the invention.
Figure 2:
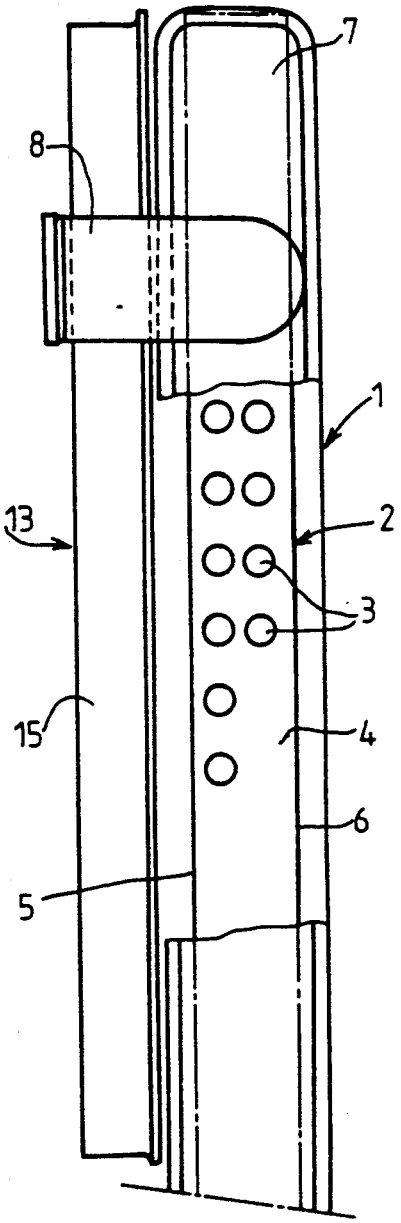
FIG. 2 is a view of part of the same apparatus as seen in the direction of the arrow F2 in FIG. 1, the radiator being shown partly cut away.
Figure 3:
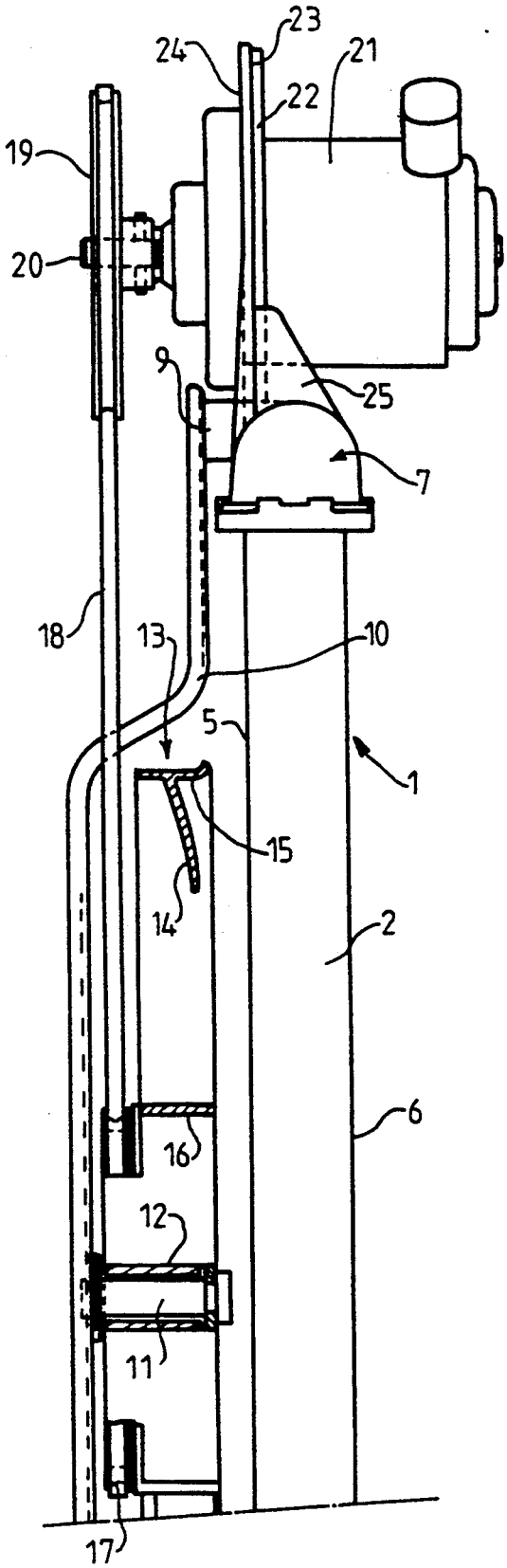
FIG. 3 is a view of part of the apparatus as seen in the direction of the arrow F3 in FIG. 1, the apparatus being shown partly in cross section.

The apparatus shown in FIGS. 1 to 3 is part of the engine cooling system of a motor vehicle, for cooling the engine coolant fluid. The apparatus comprises a heat exchanger in the form of a cooling radiator 1, comprising a bundle of tubes 2 formed from a multiplicity of elongated tubes 3, all lying parallel to each other and with each tube extending through a stack of cooling fins 4 in the form of thin rectangular plates. The tubes 3 and the fins 4 together constitute a block the shape of which is generally that of a parallelepiped, having two opposed main faces 5 and 6 parallel to the axes of the tubes.

The radiator 1 also includes a water box 7 which is arranged at one end of the tube bundle and which is provided with a connecting branch 8, or with two connecting branches, for admitting the coolant fluid into the radiator and/or for removing it from the radiator. The interior of the fluid box communicates with all of the tubes 3, in such a way as to permit the coolant fluid to flow along each tube from the water box or towards the latter. At the end of the tube bundle, not shown, which lies opposite the water box 7, the tubes may be connected to a further water box, or alternatively they may be joined together in pairs to form U-shaped tubes.

The water box 7 has a boss 9, on which is secured one end of a sheet metal support member 10 in the general shape of a strip or plate extending in the longitudinal direction of the tubes 3 between the boss 9 and a second fastening point (not shown), which is situated at the end of the heat exchanger opposite to the water box 7. This second fastening point may be located on a further water box or on a transverse stretcher. The support plate 10 extends in a longitudinal direction (vertical in FIGS. 1 to 3) parallel to the faces 5 and 6 of the tube bundle. Its transverse width, horizontal in FIGS. 1 to 3, is at right angles to the axes of the tubes. This transverse width represents only a small fraction of the width of the tube bundle. In its middle part, the support plate 10 carries a fixed trunnion 11 which is oriented at right angles to the main faces 5 and 6. A cooling fan 13 has a hub 12 which is mounted for rotation on the trunnion 11. The cooling fan 13 comprises a number of vanes 14 extending radially between the hub 12 and a peripheral or outer crown 15, which is formed integrally with the vanes 14 and with a cylindrical intermediate crown 16 which is formed with a groove 17, so that it acts as a pulley.

A drive belt 18 is engaged in the groove 17 and in the groove of a further pulley 19, or motor pulley, which is fixed to the output shaft 20, parallel to the trunnion 11, of an electric drive motor 21. The motor 21 lies outside the body of the water box 7, i.e. on the other side of the latter from the tube bundle 2, and is accordingly outside the perimeter of the radiator 1 as seen in the direction of the axes of the trunnion 11 and motor output shaft 20. In this description this direction will be referred to as the axial direction. A mounting flange 22, fixed to the casing of the motor 21 and extending in a plane at right angles to the axial direction, is secured by means of fastening screws (not shown) on a mounting surface comprising a face 23 of a mounting bracket 24, which is made by moulding integrally with the water box 7. Two reinforcing ribs 25, which are also made by moulding integrally with the water box 7 and which extend parallel to the axial direction and parallel to the longitudinal direction of the tubes 3, are joined to the mounting bracket 24.

The electric motor 21 is fitted in an aperture in the mounting bracket 24, and extends axially in both directions beyond the thickness of the radiator 1 defined between the main faces 5 and 6 of the latter (see FIG. 3). Thus the size of the apparatus in the axial direction corresponds substantially to that of the motor itself, without the thickness of the radiator adding to this size even partly. In other words, the dimension of the motor in the axial dimension is superimposed on the thickness of the heat exchanger. By contrast, if the motor 21 were arranged with the cooling fan 13 facing the main face 5 of the tube bundle, the size of the apparatus in the axial direction would correspond at least to that of the motor with the addition of the thickness of the tube bundle (that is to say the width of the cooling fins 4), together with the thickness of that part of the water box 7 which projects beyond the main face 6 of the tube bundle 2.

The diameter of the pulley 17 is greater than that of the pulley 19, so that the cooling fan 13 rotates at a slower speed than the motor 21.

Figure 4:
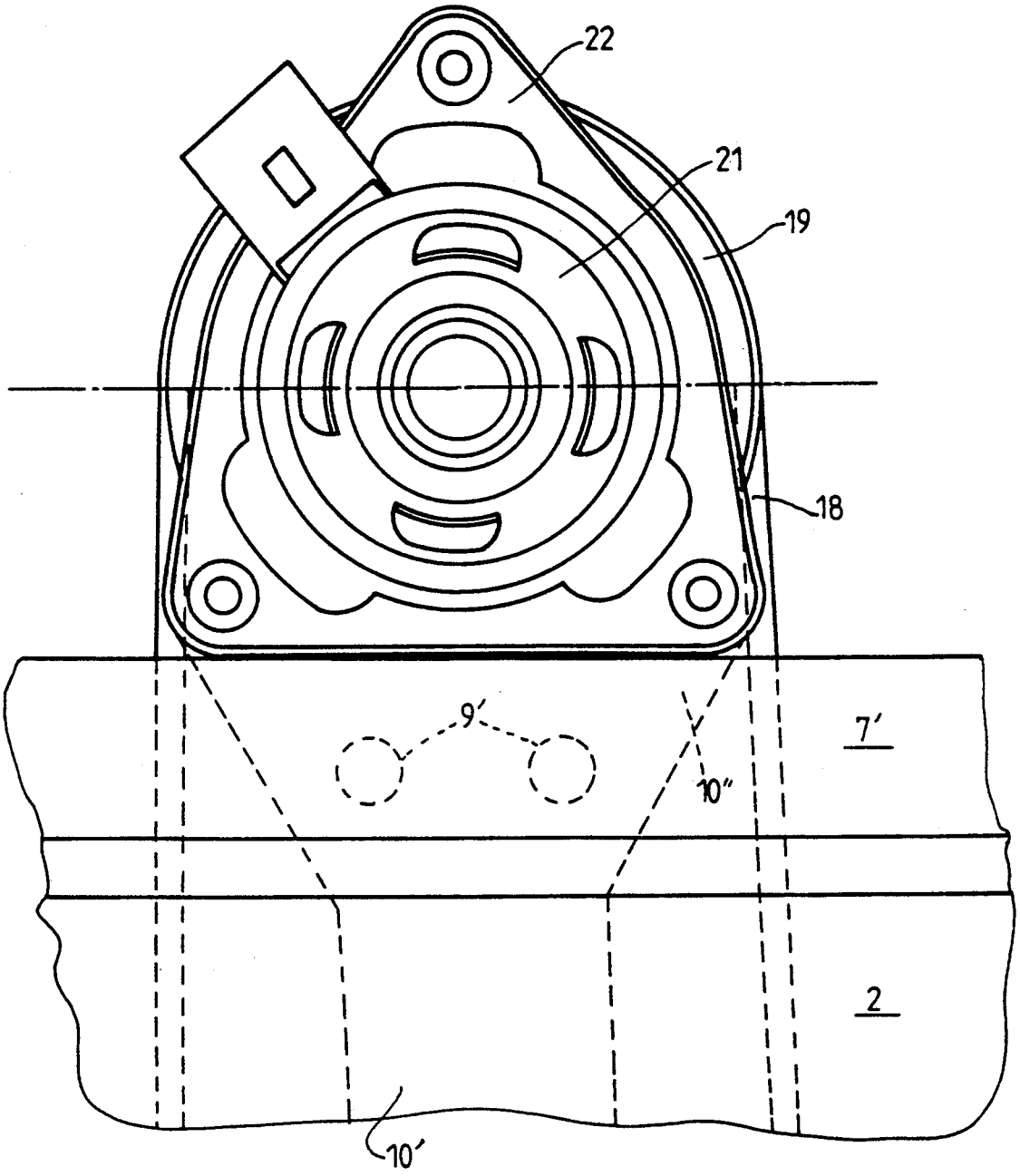
FIG. 4 is a view corresponding to FIG. 1 showing part of the apparatus in a second embodiment of the invention.
Figure 5:
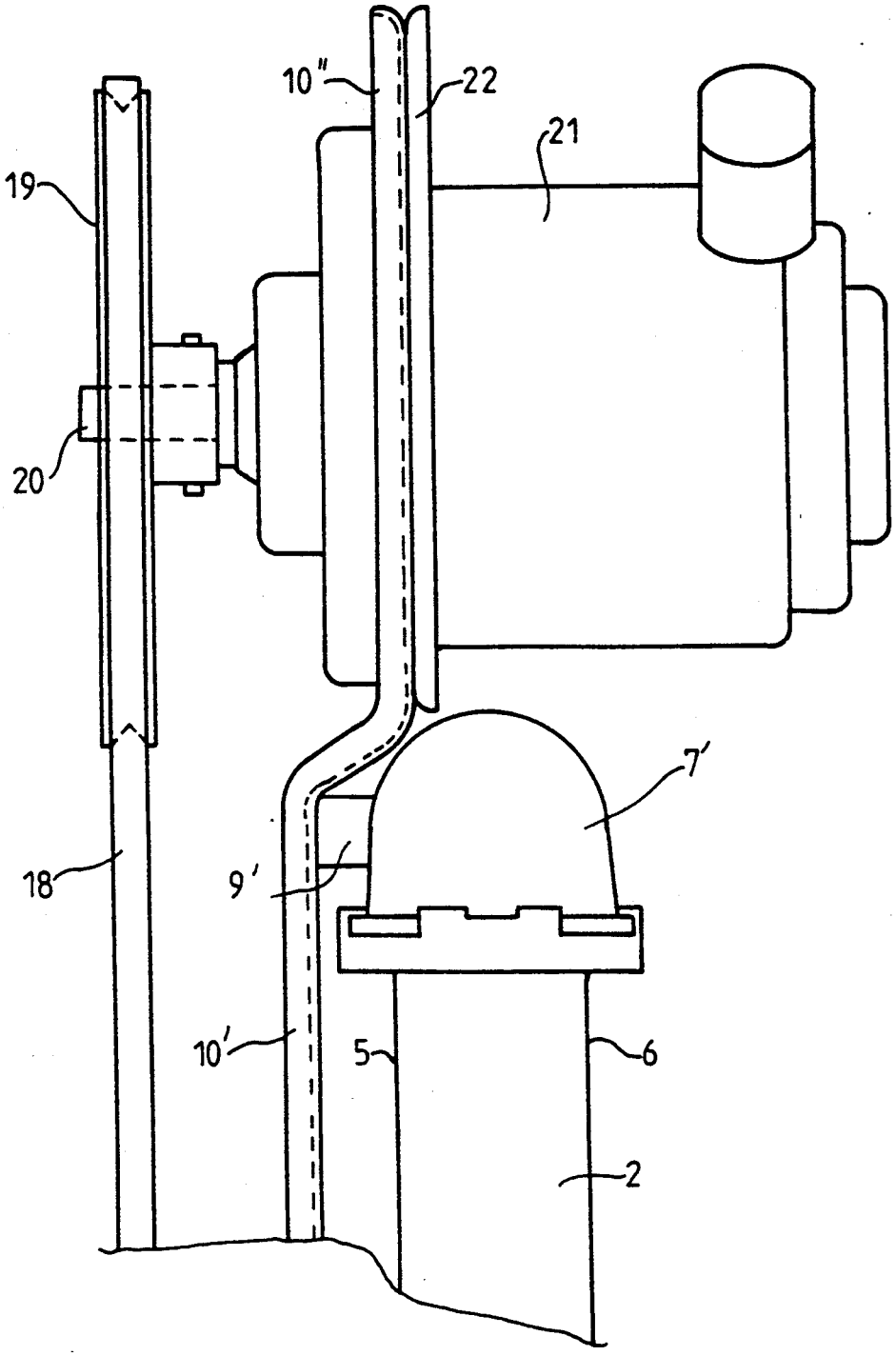
FIG. 5 is a view corresponding to FIG. 3 showing part of the apparatus in the same embodiment as in FIG. 4.

Referring now to FIGS. 4 and 5, the same reference numerals are used in these Figures as in FIGS. 1 and 2 to designate similar components or elements. The mounting bracket 24 and the reinforcing ribs 25 are absent from the embodiment shown in FIGS. 4 and 5; and the support member, 10′, which carries the cooling fan (not shown), is secured on two bosses 9′ of the water box, 7′, and is extended as indicated at 10″ beyond the bosses 9′ so as to support the motor in cantilevered relationship. This simplifies the fitting of the motorised fan unit and improves its rigidity.

Figure 6:
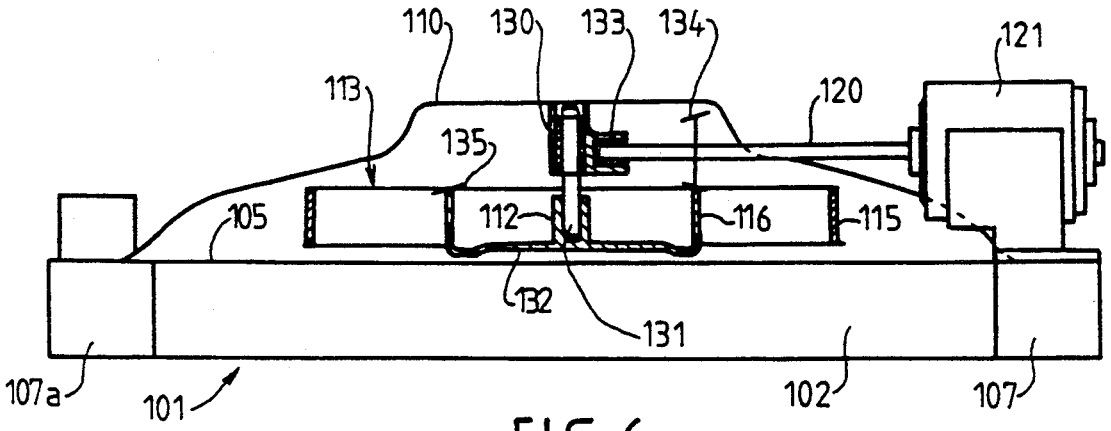
FIGS. 6 and 7 are diagrammatic views, partly in cross section, showing a further embodiment of the invention in side and front elevation, respectively.
Figure 7:
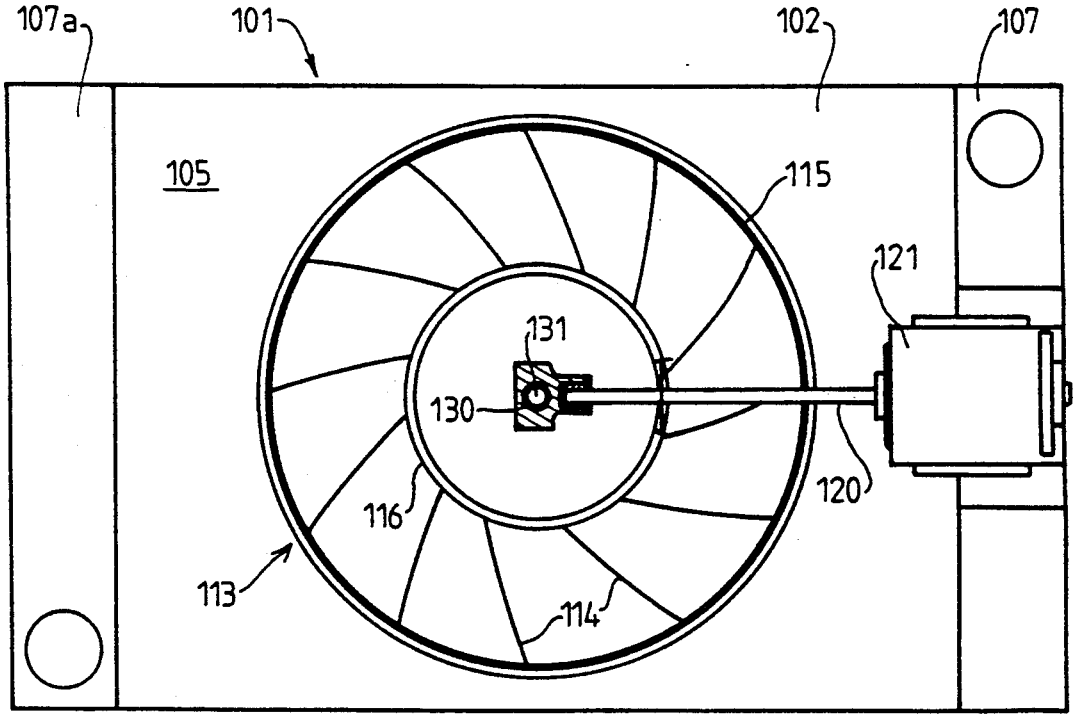

Reference is now made to FIGS. 6 and 7, which show a radiator 101 having a bundle of tubes 102 similar to the tube bundle 2 of FIGS. 1 to 5. Two fluid boxes 107 and 107*a* are arranged at opposite ends of the tube bundle 102. A ribbed sheet metal support member 110 (shown in FIG. 6 but omitted from FIG. 7 in the interests of clarity) extends from one end of the tube bundle 102 to the other, in facing relationship with a main face 105 of the tube bundle. The support member 110 is secured, by means not shown, to the water boxes 107 and 107*a*. The support member carries a bearing 130 in which a shaft 131, which is oriented at right angles to the main face 105 of the tube bundle, is rotatably mounted but prevented from moving axially. The shaft 131 is force fitted into the hub 112 of a cooling fan 113. The hub 112 is connected through a radial disc 132 to an intermediate crown 116. The intermediate crown 116 is joined to an outer or peripheral crown 115 by a number of vanes 114.

The support member 110, in the region of its connection with the water box 107, also carries an electric motor 121, the axis of rotation of which is parallel to the longitudinal direction of the tubes in the tube bundle 102, and which therefore extends at right angles to the direction of the shaft 131. The output shaft 120 of the motor extends towards the central region of the radiator 101, to terminate close to the shaft 131. The free end of the output shaft 120 is guided in a bearing 133 which is fixed with respect to the bearing 130. A bevel gear wheel 134, is fixed on the output shaft 120, meshes with a further bevel gear wheel 135. The gear wheel 135 is defined by teeth formed on the outer edge of the intermediate crown 116 facing towards the output shaft 120 (and thus turned away from the tube bundle 102). The crown 116 is joined to the radial disc 132 on the side of the former that is closer to the tube bundle 102. The ratio between the diameters of the bevel gear wheels 134 and 135, like that of the pulleys 19 and 17 in the arrangement described above with reference to FIGS. 1 to 3, is so selected as to ensure that the cooling fan 113 rotates more slowly than the motor 121.

The motor 121 extends partly in overlapping relationship with the fluid box 107, and partly level with the tube bundle 102. By contrast with the motor 21 in FIGS. 1 to 5, the motor 121 partly masks the tube bundle 102, but to a much smaller extent than the motors in the prior art that are coaxial with the cooling fan. The size of the assembly, considered in the direction of the axis of rotation of the cooling fan, is also reduced by virtue of the orientation of the motor 121 at right angles to this axis of rotation. This arrangement has the advantage over those described above with reference to FIGS. 1 to 5, that the overall surface dimensions of the apparatus, as seen in FIG. 7, are limited to those of the radiator itself.

Figure 8:
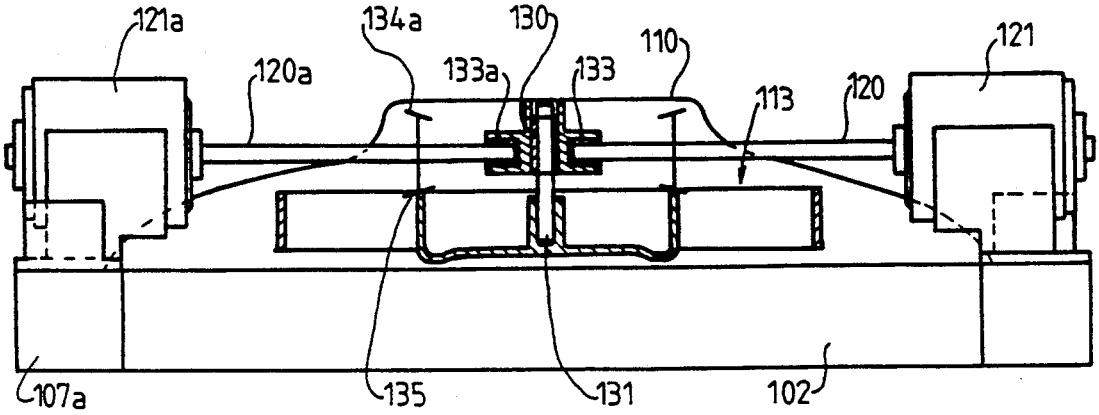
FIGS. 8 and 9 are views similar to FIGS. 6 and 7 respectively, but show a fourth embodiment of the invention.
Figure 9:
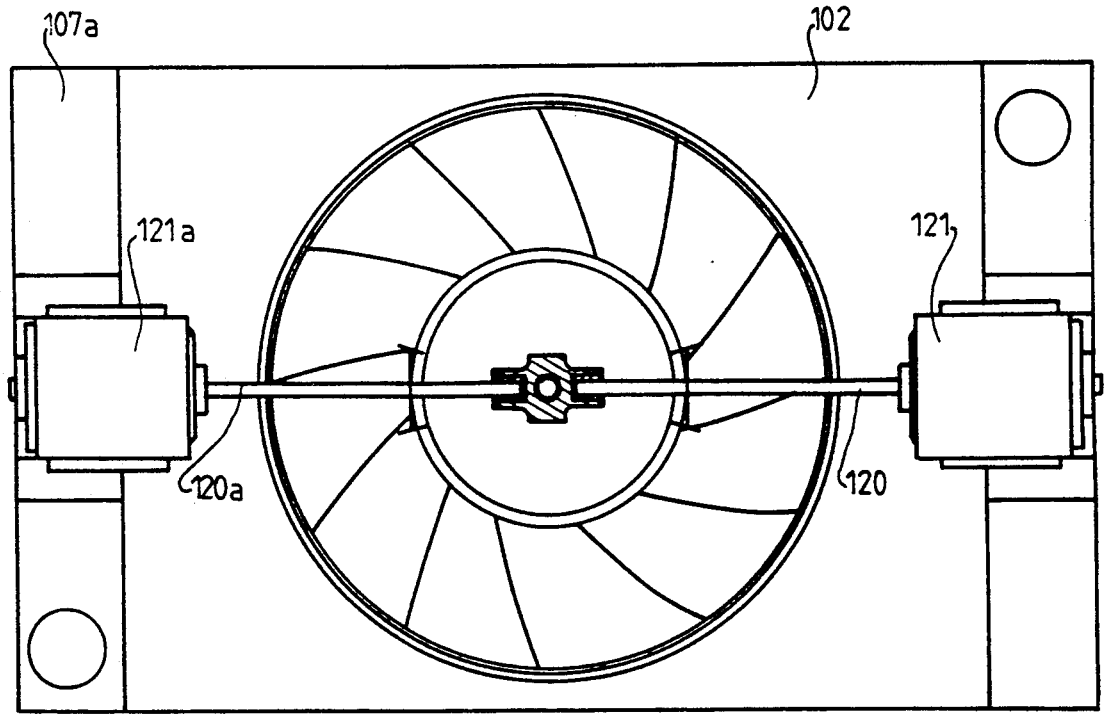

Reference is now made to FIGS. 8 and 9, in which all of the elements described above with reference to FIGS. 6 and 7 are repeated and therefore need not be described again. In FIGS. 8 and 9, a second motor **121*a* is mounted on the support member 121 level with the water box 107*a*, so as partly to overlap the latter and partly to overlap the tube bundle 102. The motors 121 and 121*a* are arranged symmetrically with each other about the axis of rotation of the cooling fan 113. The output shaft 120*a* of the motor 121*a* is coaxial with the output shaft 120 of the motor 121 and extends, again, up to a point close to the shaft 131 of the cooling fan. The free end of the output shaft 121*a* is guided in a bearing 133*a* which is fixed with respect to the bearings 130 and 133. A bevel gear wheel 134*a*, fixed on the output shaft 120*a*, also meshes with the bevel gear wheel 135**.

The cooling fan 133 may be driven by either one of the motors 121 and **121*a*, or by both together. This arrangement enables the speed of rotation of the cooling fan to be selected to have any one of several values, by energising either one of the motors, or both of them in series, or both in parallel. In addition, each motor can be less powerful than the single motor in the arrangement described above with reference to FIGS. 6 and 7**, and is therefore able to be of smaller diameter and weight. This in turn reduces the size of the apparatus in the direction of the axis of rotation of the cooling fan.

Like the motor in the embodiments described with reference to FIGS. 1 to 5, the motor or motors in the arrangements shown in FIGS. 6 to 9 may be mounted on the water box or water boxes independently of the support member for the cooling fan; or they may be mounted on the cooling fan, as desired.

As is known, the or each motor in the various embodiments of the apparatus described above may be controlled in such a way as to rotate intermittently or at variable speed according to the temperature of the coolant fluid, this being controlled by means of control devices which include a temperature sensor disposed in the corresponding water box. The apparatus in accordance with the invention enables these control means to be grouped close to the motor, for example in a control box which is mounted on the water box, so that the control means can then be connected to the motor or motors through conductors which need only be short.

What is claimed is:

1. Heat exchanger apparatus for heat transfer between a fluid and the ambient air, comprising: a heat exchange comprising a bundle of tubes and defining two opposed, parallel main faces with the tubes extending parallel to said main faces, together with at least one water box, the tubes being open into the interior of said water box; a cooling fan mounted on the heat exchanger so that the fan is in facing relationship with one of said main faces of the heat exchanger and in direct air communication with the tube bundle, the cooling fan defining an axis of rotation at right angles to said main faces of the heat exchanger so as to produce a forced air flow through the heat exchanger; a drive motor; drive means coupling the cooling fan with the drive motor for driving the cooling fan; and means mounting the motor on the heat exchanger wherein the drive motor lies outside the perimeter of the heat exchanger itself, with its dimension in the direction of said axis of rotation of the cooling fan being at least partly superimposed on the thickness of the heat exchanger.

2. Apparatus according to claim 1, wherein the drive motor is disposed outside the water box with respect to the tube bundle.

3. Apparatus according to claim 1, wherein the water box defines a mounting surface, the drive motor being secured on the said mounting surface.

4. Apparatus according to claim 1, wherein the means mounting the cooling fan and drive motor on the heat exchanger comprise a support member extending in facing relationship with the same said main face of the heat exchanger as the cooling fan, and securing means securing said support member on the heat exchanger in the region of said water box and in a location on the heat exchanger remote from said water box.

5. Apparatus according to claim 4, wherein the said support member includes a portion thereof which is cantilevered beyond the said water box, the drive motor being carried on the said cantilevered portion.

6. Apparatus according to claim 1, wherein the said drive means comprise speed reduction means whereby the velocity of rotation of the cooling fan is less than that of the drive motor.

7. Apparatus according to claim 1, wherein the cooling fan has a drive shaft, the drive means comprising an output shaft of the drive motor, the drive shaft of the cooling fan, and intermeshing bevel gear wheels coupling the two said shafts together.

8. Apparatus according to claim 1, wherein the said drive means comprise a first pulley carried by the drive motor, a second pulley carried by the cooling fan, and a drive belt coupling the two pulleys together.

9. A heat exchanger apparatus comprising: a heat exchanger tank comprising of bundle of tubes and defining two opposed main faces, together with at least one water box, the tubes being open into the interior of said water box and defining a perimeter region; a cooling fan mounted on the heat exchanger so that the fan is in facing relationship with one of the said main faces of the heat exchanger and in direct air communication with the tube bundle, the cooling fan defining an axis of rotation at right angles to said main faces of the heat exchanger so as to produce a forced air flow through the heat exchanger; a drive motor mounted on the heat exchanger tank, the motor being disposed at least partly outside the perimeter region of the tube bundle as seen in the direction of said axis of rotation of the cooling fan; and drive means coupling the cooling fan with the drive motor for driving the cooling fan wherein the drive motor at least partly overlaps the water box, with its output shaft being oriented at a right angle to the axis of rotation of the cooling fan.

10. A heat exchanger apparatus comprising: a heat exchanger tank comprising a bundle of tubes and defining two opposed main faces, together with at least one water box, the tubes being open into the interior of said water box and defining a perimeter region; a cooling fan mounted on the heat exchanger so that the fan is in facing relationship with one of the said main faces of the heat exchanger and in direct air communication with the tube bundle, the cooling fan defining an axis of rotation at right angles to said main faces of the heat exchanger so as to produce a forced air flow through the heat exchanger; a drive motor mounted on the heat exchanger tank, the motor being disposed at least partly outside the perimeter region of the tube bundle as seen in the direction of said axis of rotation of the cooling fan; and drive means coupling the cooling fan with the drive motor for driving the cooling fan wherein the heat exchanger has two said water boxes arranged at opposite ends of the tube bundle, the apparatus further including a second drive motor, means mounting the second drive motor on the heat exchanger, and further drive means coupling the second drive motor with the cooling fan, the drive means associated with each motor including an output shaft of the respective motor oriented in an axial direction at right angles to the axis of rotation of the cooling fan, with each drive motor being disposed at least partly in overlapping relationship with the corresponding said water box.

11. A heat exchanger apparatus comprising:

a heat exchanger member having a pair of opposed main faces and a pair of end portions;

drive means mounted to one of said end portion;

a cooling fan member mounted to the heat exchanger in facing relationship with one of said main faces of the heat exchanger, the cooling fan member defining an axis of rotation; and coupling means coupling said drive means to said fan member for driving said fan member wherein the opposed main faces define the width of the heat exchanger and wherein the drive means comprises a motor having a rotational shaft whose length defines the width of the motor, the width of the motor being superimposed on the width of the heat exchanger, the motor being disposed entirely outside the perimeter of the heat exchanger.

12. A heat exchanger according to claim 11 wherein the drive means comprises a motor having a drive shaft disposed substantially parallel to said main faces of the heat exchanger, the motor being disposed at least partially outside the periphery of the heat exchanger tank.

13. A heat exchanger apparatus according to claim 11 wherein the end portion on which the drive means is mounted comprises a water box.

14. A heat exchanger apparatus according to claim 11 wherein said coupling means includes means for operating said drive means and said cooling fan member at different speeds.

15. A heat exchanger apparatus according to claim 11 wherein the rotational shaft of the motor is disposed parallel to the axis of rotation of the cooling fan member.

16. A heat exchanger apparatus according to claim 12 wherein the rotational shaft of the motor is disposed at a right angle to the axis of rotation of the cooling fan member.

* * * * *